United States Patent [19]

Norris

[11] 4,090,178

[45] May 16, 1978

[54] COMBINATION SMOKE DETECTOR AND LAMP STRUCTURE

[76] Inventor: Elwood G. Norris, 1520 Canterbury Dr., Salt Lake City, Utah 84108

[21] Appl. No.: 712,954

[22] Filed: Aug. 9, 1976

[51] Int. Cl.[2] ..... G08B 17/10

[52] U.S. Cl. ..... 340/237 S; 340/220

[58] Field of Search ..... 340/220, 237 S, 227.1; 240/2 R, 78 R, 78 DA, 78 CF

[56] References Cited

U.S. PATENT DOCUMENTS

| | | | |
|---|---|---|---|
| 1,068,440 | 7/1913 | McCarthy | 340/227.1 |
| 2,100,908 | 11/1937 | Merdan | 340/220 |
| 3,320,601 | 5/1967 | Yankus | 340/220 X |
| 3,555,531 | 1/1971 | Montone | 340/220 X |
| 3,609,730 | 9/1971 | Hornung | 340/333 X |

*Primary Examiner*—John W. Caldwell, Sr.
*Assistant Examiner*—Daniel Myer
*Attorney, Agent, or Firm*—Criddle, Thorpe & Western

[57] ABSTRACT

Structure for combining at one location smoke detection circuitry and wall or ceiling lamp apparatus. The structure includes a housing formed with a bottom wall and side walls and having an opening at the top thereof. The bottom wall has an opening centrally located therein. Also included is a lamp socket disposed in the housing so that the socket opening may receive the base of a lamp bulb through the opening in the bottom wall. Smoke detection circuitry is also disposed in the housing about the lamp socket. The circuitry includes an audible sound producing mechanism and a detector element responsive to the presence of smoke thereat for causing the sound producing mechanism to produce audible sound. The circuitry is powered alternatively by a rechargeable battery or by the current supplied to the lamp bulb.

9 Claims, 5 Drawing Figures

COMBINATION SMOKE DETECTOR AND LAMP STRUCTURE

BACKGROUND OF THE INVENTION

This invention relates to a combination fire detector and lamp structure.

The danger to life of fires occurring in the home has resulted in a requirement in many communities that some type of fire or smoke detector apparatus be installed in every new home constructed. Such requirements and the concern for the potential loss of life and property from fires in the home have given rise to the development of a variety of different type fire alarms.

Substantially all such alarms provide for placement of some type of detector apparatus on a wall or ceiling of the house to actuate audible signalling apparatus when smoke, heat or fire-produced gas is detected. Detectors which are either heat sensitive, smoke sensitive or gas sensitive (hereinafter collectively referred to as fire detectors) are available on the market and such detectors are generally powered either from self-contained batteries or from the standard household A.C. power supply.

For the currently available alarms, if the detector is powered from household current, then a separate electrical outlet box must be provided for each alarm installed. For either battery powered or A.C. powered alarms, some type of accommodation must be made for mounting each unit on the wall or ceiling. This, of course, increases the contruction cost of a home and also uses valuable space on the walls or ceilings.

SUMMARY OF THE INVENTION

It is an object of the present invention to provide a combination fire detector and lamp structure suitable for mounting on a wall or ceiling.

It is another object of the present invention to provide a fire detector and lamp structure which may be mounted on a standard electrical outlet box used in buildings.

It is still another object of the present invention to provide a fire detector and lamp structure which is economical to construct and which gives the appearance of being only a lamp.

The above and other objects of the present invention are realized in one illustrative embodiment which includes a housing having a bottom wall and side walls and being open at the top thereof, with the bottom wall including an opening centrally located therein. The housing is provided with apparatus for mounting the housing on a standard electrical outlet box such as is used in home and building construction. A lamp socket is disposed centrally in the housing so that the socket opening may recieve the base of a lamp bulb through the opening in the bottom wall of the housing. Fire detection circuitry is also disposed in the housing about the lamp socket, such circuitry including an audible sound producing device and a detector element for causing the sound producing device to produce an audible sound upon the occurrence of a fire. A rechargeable battery may be included in the housing and coupled to the circuitry so that the circuitry is powered either by electrical current delivered to the lamp socket or by the battery. Current delivered to the lamp socket is also delivered to the battery to recharge the battery.

In an alternative embodiment of the present invention, fire detection circuitry is enclosed in a housing having a bottom wall and side walls and being adapted for mounting on a standard electrical outlet box. The housing is also adapted to receive and hold lamp structure on the underneath side thereof and to allow the lamp in the lamp structure to be coupled through the housing to electrical conductors terminating in the electrical outlet box on which the housing is mounted. Again, a rechargeable battery may be provided in the housing to supply power to the fire detection circuitry alternatively with the current supplied over the electrical conductors.

Other embodiments of the invention will be discussed later.

DESCRIPTION OF THE DRAWINGS

The above and other objects, features and advantages of the present invention will become apparent from a consideration of the following detailed description presented in connection with the accompanying drawings in which.

DETAILED DESCRIPTION

The various embodiments of the invention described herein all concern the combination of fire detector apparatus and wall or ceiling lamp structure in a unitary arrangement to serve both to detect the presence of fire and to function as a conventional lamp. With each embodiment, the wiring and space normally required to accommodate a conventional wall or ceiling lamp readily accommodates the combination fire detector and lamp structures.

Figure 1:
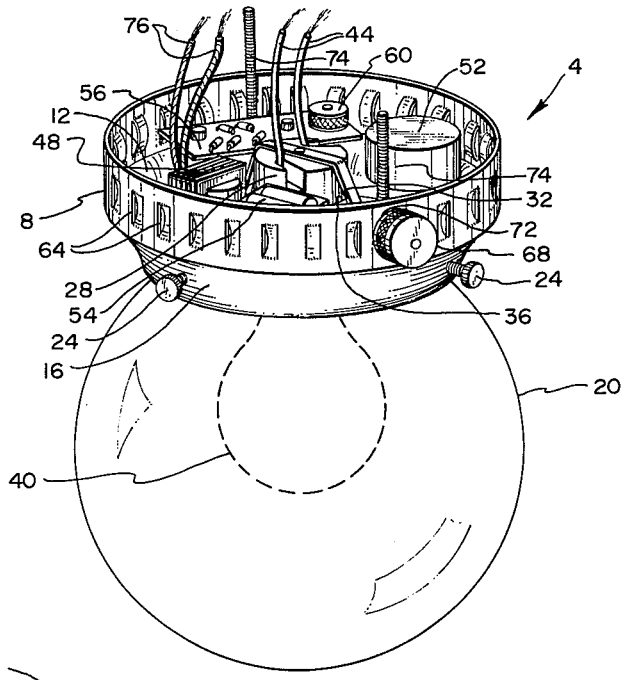
FIG. 1 is a perspective view of one illustrative embodiment of a combination fire detector and lamp structure made in accordance with the principles of the present invention.

In FIG. 1 there is shown a perspective view of the fire detector and lamp structure which includes a circular lamp base housing 4. The housing 4 includes a side wall 8 and a bottom wall 12 on which other components of the structure are mounted. The top of the housing 4 is open and this opening, defined by the upper edge of the side wall 8, defines a generally flat plane suitable for the stable placement of the housing against a flat wall or ceiling. Extending downwardly from the bottom wall 12 of the housing 4 is a circular lip 16 within which is received a lamp cover 20. Finger screws 24 are provided in the wall of the lip 16 for securing the lamp cover 20 in place in the conventional manner.

Disposed in the housing 4 is a lamp socket 28 which is held in place by a brace 32 secured to the socket 28 and to the bottom wall 12 of the housing. The lamp socket 28 is disposed partially within an opening 36 centrally located in the bottom wall 12 of the housing 4 so that the hollow of the lamp socket is directed downwardly for receiving thereinto the base of a light bulb represented by dotted lines 40. Extending upwardly from the back of the lamp socket 28 is a pair of wires 44 for connecting the socket to electrical wiring in the building in which the FIG. 1 structure might be installed. The structure as thus far described is conventional with presently used wall or ceiling lamps.

Disposed about the lamp socket 28 are various elements of a fire detector including a transformer 48, a sound producing device 52, a rechargeable battery pack 54, and a circuit board 56 containing the remaining elements of the fire detector. All these elements are shown in a schematic of an illustrative smoke detector circuit suitable for use in the present invention shown in FIG. 4. The operation of this circuitry will be described later.

The fire detector apparatus of the FIG. 1 structure includes a detector element 60 mounted on the circuit board 56. The element 60 is a conventional element adapted to enable the passage thereinto of smoke or gas which may be detected by circuitry located within the element and on the circuit board 56. The facilitate the migration of smoke or gas to the detector element 60, a plurality of openings 64 are formed in the side wall 8 of the housing 4. These openings may be of any form, shape or size suitable for allowing the passage therethrough of smoke or gas produced by fires. Provision of these openings enables smoke or gas produced by a fire to reach the detector element 60 which, in turn, causes the sound producing device 52 to produce an audible sound and warn of the fire.

An alternative arrangement for enabling detection of the fire is also shown in FIG. 1 by dotted lines 68. Specifically, a smoke or gas detector element 68 is shown protruding through an opening 72 in the side wall 8 of the housing 4 so that the element is exposed outside of the housing. With this arrangement, the element 68 would be connected into the detector circuitry in place of the detector element 60.

The lamp base housing 4 may be mounted on a standard electrical outlet box in the usual manner by a pair of bolts 74 extending upwardly through the bottom wall 12 of the housing. The fire detector circuitry is coupled by way of conductors 76 to electrical wiring terminating in the outlet box on which the lamp base housing 4 is mounted.

Figure 2A:
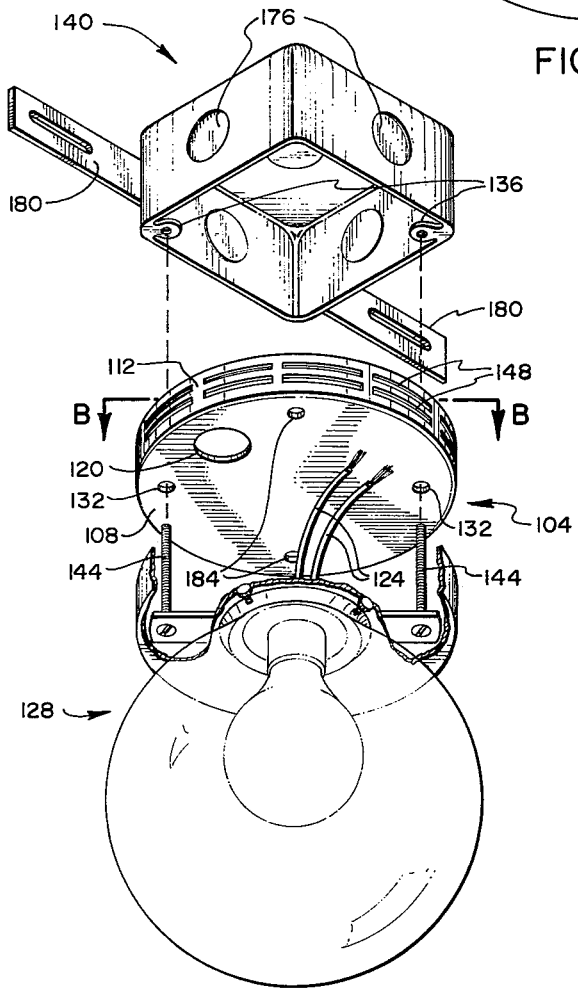
FIGS. 2A and 2B show respectively an exploded, partially cut-away view of another illustrative embodiment of a combination fire detector and lamp structure and a top plan view of the adapter housing of the structure of FIG. 2A.
Figure 2B:
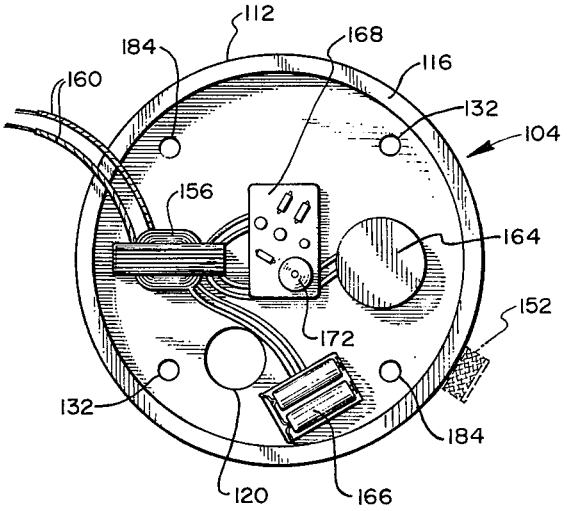

Composite FIG. 2 shows an alternative embodiment of a combination fire detector and lamp structure which includes a lamp adapter housing 104 having a bottom wall 108 and a side wall 112 extending upwardly from the perimeter of the bottom wall. A lip 116 (FIG. 2B) extends inwardly from the upper edge of the side wall 112. The adapter housing 104 shown in the drawings is generally circular in shape but, of course, it could have other shapes as well.

Located in the bottom wall 108 of the housing is an opening 120 to enable the threading therethrough of a wire pair 124 of a lamp 128 to be mounted on the adapter housing. Also located in the bottom wall 108 are a pair of openings 132 diametrically spaced apart on either side of the housing. The distance separating the openings 132 is the same as the distance separating threaded bores 136 of a standard electrical outlet box 140. The openings 132 are provided to enable the insertion therethrough of bolts 144 of the lamp 128. The lamp 128 may be any standard wall or ceiling lamp constructed for mounting on a standard electrical outlet box 140.

Located in the side wall 112 of the adapter housing 104 are a plurality of openings 148. These openings are provided to allow the passage of smoke or gas to the interior of the housing where fire detection apparatus is disposed. As with the FIG. 1 embodiment, an alternative arrangement for detecting smoke or gas would be to locate a detector element, shown by dotted line 152 in FIG. 2B, outside the adapter housing 104. Specifically, the detector element 152 would be disposed to extend through an opening in the side wall 112 of the adapter housing 104 for better exposure to smoke or gas produced by a fire.

Referring to FIG. 2B, there is shown fire detector circuitry disposed within the adapter housing 104. Included is a transformer 156 to which is connected a pair of conductors 160 for coupling to an A.C. power source. Also included is an audible sound producing device 164, a rechargeable battery pack 166, and a circuit board 168 upon which the other components, such as a detector element 172, are mounted. The elements of the fire detector are positioned in the housing 104 so as not to obstruct the insertion of bolts in the openings 132 to extend from the underneath side of the housing up through and out the opening in the housing. The fire detector elements are likewise positioned so that insertion of electrical conductors through the opening 120 will not be obstructed.

The adapter housing 104 is contructed to enable mounting the housing on a standard electrical outlet box 140 (FIG. 2A). Such an outlet box includes conventional punch-out portions 176 through which electrical conductors may be inserted, and a pair of arms 180 extending from one side of the box to facilitate mounting the box on a wall or ceiling stud. Threaded bores 136 of the electrical outlet box were already mentioned and are shown in FIG. 2A as being in opposite corners of the box for receiving bolts to support and hold a wall or ceiling lamp.

The lamp 128 and adapter housing 104 are mounted on the electrical outlet box 140 by placing the housing 104 against the ceiling so that the openings 132 are in alignment with the threaded bores 136. The lamp 128 is then placed against the underneath side of the housing 104 and the bolts 144 are inserted through the openings 132 of the housing and screwed into the threaded bores 136. The lamp thus holds the housing 104 against the ceiling or wall adjacent to which the electrical outlet box 140 is mounted. Advantageously, the diameter of the housing 104 is greater than the diameter of the base of the lamp 128 so that the lamp base will press against the housing to hold it against the ceiling or wall.

An alternative arrangement for mounting the adapter housing 104 on the electrical outlet box 140 would simply be to place bolts through the openings 132 and screw the bolts into the threaded bores 136 of the box to hold the housing by itself against the wall or ceiling adjacent to which the box is mounted. Two additional openings 184 which would be threaded to receive bolts would then be provided in the bottom wall 108 of the housing 104 to enable mounting a lamp on the housing 104. A plurality of such openings 184 could be provided to accommodate different size lamps, while only a single standard size electrical outlet box would be needed.

Figure 3:
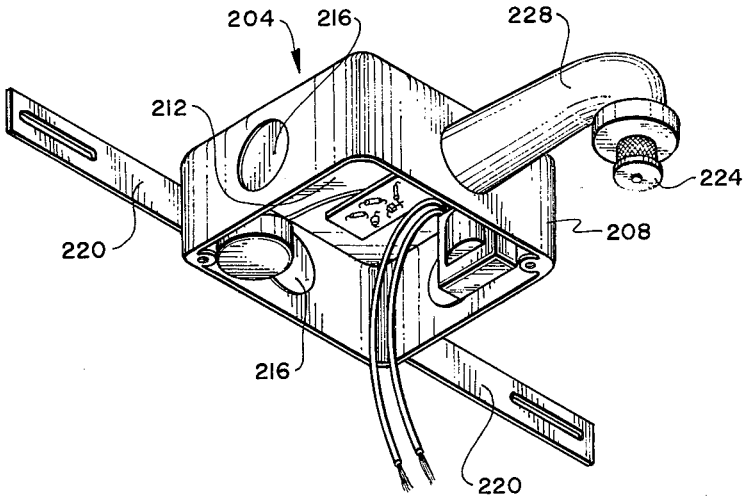
FIG. 3 is a perspective view of a third embodiment of the present invention.

A third embodiment of the present invention is shown in FIG. 3 to include a conventional electrical outlet box 204 having side walls 208 and a top wall 212. Punch-out portions 216 are provided in the side walls and top wall to enable insertion of electrical conductors therethrough. A pair of arms 220 are attached on one of the side walls of the box to facilitate mounting the box on a ceiling or wall stud.

Fire detector circuitry is mounted within the electrical outlet box 204 as shown in FIG. 3, with such circuitry again including the conventional components of a fire detector. A detector element 224 of such circuitry is mounted in the end of a conduit 228 which extends outwardly and downwardly from one side of the outlet box 204. The detector element 224 is positioned in the end of the conduit 228 so that when the electrical outlet box 204 is mounted on a ceiling or wall stud and the corresponding ceiling or wallboard is in place, the element 224 will be substantially flush with the exterior surface of the ceiling or wallboard. Electrical conductors extend through the conduit 228 to connect the detector element 224 to the rest of the fire detector circuitry.

With the arrangement shown in FIG. 3, conventional wall and ceiling lamps would be mounted on the electrical outlet box 204 in the usual manner but, again, a single electrical outlet box could serve both for the fire detection apparatus and a lamp.

Figure 4:
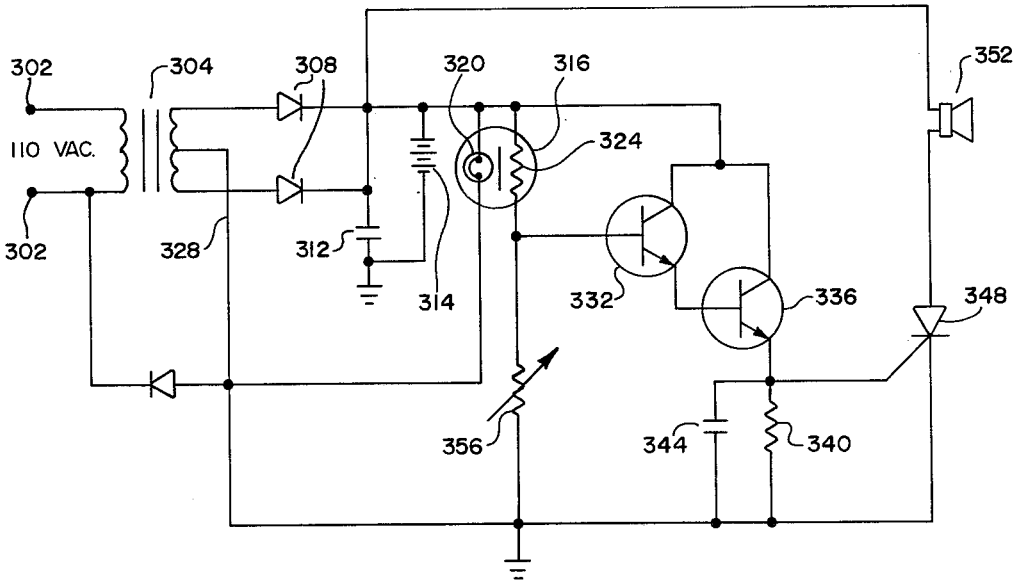
FIG. 4 is an exemplary smoke detector circuit suitable for use in the present invention.

FIG. 4 shows one illustrative fire detector circuit suitable for use in the present invention. This circuit is adapted to be connected to a 110 volt A.C. source by terminals 302. Included is a transformer 304, the primary winding of which is coupled across the A.C. voltage source. The ends of the secondary winding are coupled to a pair of diodes 308 for rectifying the current produced in the secondary winding of the transformer. A capacitor 312 is coupled to the cathode side of each of the diodes for smoothing the voltage applied to a detector element 316. A rechargeable battery 314 is coupled across the capacitor 312.

The detector element 316 is designed to detect the presence of smoke. The element includes a light source 320 which is connected between a center tap 328 of the secondary winding of the transformer 304 and the output of the diodes 308. A resistive element 324 is also included in the detector element 316 and is coupled between the output of the diodes 308 and the base of a transistor 332. The emitter of the transistor 332 is connected to the base of another transistor 336 and the collectors of both transistors are coupled together and to the output of the diodes 308. The emitter of transistor 336 is coupled to a filter comprising a resistor 340 and a capacitor 344. The other side of the filter is coupled to ground. The emitter of the transistor 336 is also coupled to the gate electrode of a unilateral semiconductor triode switch 348 of the type known as a siliconcontrolled rectifier (SCR). An audible sound producing device 352 is coupled in series with the SCR 348 between the output of the diodes 308 and ground. A variable resistor 356 is coupled in series with the resistive element 324 of the detector element 316 for adjusting the sensitivity of the detector element.

In operation, the transformer 304 and diodes 308 produce from the 110 volt A.C. input a six volt D.C. output for application to the rechargeable battery 314, to the audible sound producing device 352 and to the detector element 316. This current lights the lamp 320 in the detector element, with the lamp being shielded so as not to direct any light directly onto the resistive element 324. With no light falling upon the resistive element 324, its resistance is fairly high so that very little current is conducted from the diodes 308 to the base of the transistor 332. When smoke enters the space between the lamp 320 and the resistive element 324, the smoke disperses the light in such a fashion that it impinges upon the resistive element 324 thereby lowering the element's resistance so that more current is conducted to the base of the transistor 332. With the increased current applied to the base of the transistor 332, the transistor is caused to conduct so that current is similarly applied via the transistor 332 to the base of transistor 336. The transistor 336 is thus caused to conduct and current is thereby applied to the gate electrode of the SCR 348 causing it to conduct so that current is allowed to flow through the sound producing device 352. The sound producing device 352 thus produces an audible sound to warn that smoke has been detected and thus that a fire has been started. The audible sound producing device 352 could be a buzzer, a bell, or some other commonly used device.

By providing the rechargeable battery 314, operation of the fire detector circuit of FIG. 4 can be maintained even though the A.C. power may be cut off. Thus, when the A.C. power is being supplied to the terminals 302, a direct current is supplied the battery 314 to maintain the charge in the battery. (An exemplary battery suitable for the circuit of FIG. 4 is a conventional six volt nickel-cadmium rechargeable battery.) When the A.C. power is cut off, the battery 314 supplies the power to operate the circuit. (The diodes 308 prevent drain on the battery 314 via the transformer.) Thus, coupling the terminals 302 to a wire pair which supplies current to the associated lamp would result in an arrangement where the battery 314 would be recharged during the time the lamp was "on", and would supply the power to operate the circuit during the time the lamp was "off". This arrangement would be especially suitable for use with electrical outlet boxes already in place which have only two wire terminations. With such outlet boxes, power is supplied to the wire terminations only when a corresponding wall switch is in the "on" position. With electrical outlet boxes having three wire terminations, power is supplied to two of the terminations all the time so that coupling the terminals 302 to such terminations would provide charging current to the battery 314 even though the associated lamp was not "on". The battery 314 would then supply the power to the circuit only when the houshold or building power cut off by a general power failure.

Although the circuit shown in FIG. 4 is adapted to detect the presence of smoke, numerous other types of fire detection circuits could be utilized such as those which detect an increase in temperature, those which detect the presence of various kinds of gases normally produced by a fire, etc.

In the manner described, a very simple, attractive and utilitarian combination fire detector and lamp structure may be provided. The structure allows for a single electrical outlet box to be used to accommodate both a fire detector and a wall or ceiling lamp and this results in the savings of both money and wall or ceiling space. Current for lighting the lamp also serves to recharge a rechargeable battery which can then power the fire detector when normal power is cut off.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. Combination fire detector and lamp structure comprising a housing formed with a bottom wall and side walls, and open at the top thereof, said bottom wall having an opening centrally located therein, said housing including means for mounting the housing on a standard electrical outlet box, a lamp socket disposed centrally in the housing so that the socket opening may receive the base of a lamp bulb through the opening in said bottom wall, and fire detector circuitry disposed in the housing about said lamp socket, said circuitry including an audible sound producing device and a detector element responsive to the occurrence of fire at or near the detector for causing the sound producing device to produce audible sound.

2. The structure of claim 1 wherein said housing includes one or more additional openings in the walls thereof adapted to allow the passage of smoke or gas from outside the housing through the additional openings into the housing.

3. The structure of claim 1 wherein said housing includes an additional opening in the wall thereof, and wherein said detector element is disposed in the housing to protrude through said additional opening.

4. The structure of claim 1 wherein said fire detector circuitry further includes means for coupling the circuitry to an A.C. power source, rectifying means connected to said coupling means for producing a direct current from supplied A.C. power, and a rechargeable battery coupled to said rectifying means and to said audible sound producing device and detector element for receiving current from the rectifying means to charge the battery and for supplying current to the audible sound producing device and detector element when the A.C. power source fails to supply power.

5. A combination lamp adapter and fire detector comprising a housing having a bottom wall and side walls, and open at the top thereof, said bottom wall including a pair of spaced apart openings through which bolts may be inserted for screwing into the threaded bores of a standard electrical outlet box, said bottom wall further including a third opening through which electrical conductors from a lamp may be strung, the opening in the top of the housing defining a generally flat plane to enable the stable placement of the housing against a wall or ceiling with the opening in the top of the housing contiguous with the wall or ceiling, means for mounting a lamp structure on the underneath side of said housing, and fire detector circuitry disposed in the housing and positioned so as not to obstruct the insertion of electrical conductors through the third opening from outside the housing and so as not to obstruct the insertion of bolts through the pair of openings to extend from outside the bottom wall through the pair of openings and out the top of the housing, said fire detector circuitry including an audible sound producing device and a detector element for detecting the occurrence of a fire and for producing an audible sound as a result of such detection.

6. The combination of claim 5 wherein said housing includes one or more openings in the side walls thereof adapted to allow the passage of smoke or other gas from outside the housing through the openings into the housing.

7. The combination of claim 5 wherein said housing includes an opening in the side walls thereof, and wherein the detector element is disposed in the housing to protrude through the opening in the side walls.

8. The combination of claim 5 wherein said fire detector circuitry further includes means for coupling the circuitry to an A.C. power source, rectifying means connected to said coupling means for producing a direct current from supplied A.C. power, and a rechargeable battery coupled to said rectifying means and to said audible sound producing device and said detector element for receiving current from the rectifying means to charge the battery and for supplying current to the audible sound producing device and detector element when the A.C. power source fails to supply power.

9. An electrical outlet box and fire detector comprising a housing having a top wall and side walls, and open at the bottom thereof, means attached to said housing for mounting the housing on a ceiling or wall stud so that the housing opening is contiguous to the corresponding ceiling or wall, a plurality of punch-out portions formed in the housing and adapted for removal by the application of pressure thereto to thereby provide openings through which electrical conduits or conductors may be inserted, a conduit extending laterally from the housing, and fire detector circuitry adapted to be powered by an A.C. source, said circuitry including an audible sound producing device disposed in the housing and a detector element mounted at the free end of said conduit for detecting the presence of smoke or other gas and for causing said sound producing device to produce audible sound, said detector element being mounted at the end of the conduit so that when the housing is mounted with the opening contiguous to a ceiling or wall, the detector element is disposed at the outside surface of the ceiling or wall.

* * * * *